US009254674B2

(12) United States Patent
Beck

(10) Patent No.: US 9,254,674 B2
(45) Date of Patent: Feb. 9, 2016

(54) RESERVOIR HAVING PARTICLE TRAPPING FEATURES

(71) Applicant: Palo Alto Research Center Incorporated, Palo Alto, CA (US)

(72) Inventor: Victor Beck, Menlo Park, CA (US)

(73) Assignee: PALO ALTO RESEARCH CENTER INCORPORATED, Palo Alto, CA (US)

( * ) Notice: Subject to any disclaimer, the term of this patent is extended or adjusted under 35 U.S.C. 154(b) by 0 days.

(21) Appl. No.: 14/189,203

(22) Filed: Feb. 25, 2014

(65) Prior Publication Data

US 2015/0239253 A1 Aug. 27, 2015

(51) Int. Cl.
*B41J 2/175* (2006.01)

(52) U.S. Cl.
CPC ..... *B41J 2/17563* (2013.01)

(58) Field of Classification Search
CPC .. B41J 2/17562; B41J 2/1721; B41J 2/17513; B41J 2/17593; B41J 2/185; B41J 2002/14403
See application file for complete search history.

(56) References Cited

U.S. PATENT DOCUMENTS

| | | | | |
|---|---|---|---|---|
| 4,490,731 | A | 12/1984 | Vaught | |
| 4,593,292 | A | 6/1986 | Lewis | |
| 4,607,266 | A | 8/1986 | DeBonte | |
| 4,814,786 | A * | 3/1989 | Hoisington et al. | 347/88 |
| 4,864,329 | A | 9/1989 | Kneezel et al. | |
| 4,940,997 | A | 7/1990 | Hamlin et al. | |
| 5,742,313 | A | 4/1998 | Hine | |
| 5,823,676 | A | 10/1998 | Khijniak et al. | |
| 5,993,053 | A | 11/1999 | Clark | |
| 6,183,074 | B1 | 2/2001 | Miyashita et al. | |
| 2013/0147886 | A1 | 6/2013 | Hays | |

FOREIGN PATENT DOCUMENTS

| | | |
|---|---|---|
| WO | WO02096654 | 12/2002 |
| WO | WO2009077790 | 6/2009 |
| WO | WO2010077386 | 7/2010 |

OTHER PUBLICATIONS

Barakos et al., "Natural Convection Flow in a Square Cavity Revisited: Laminar and Turbulent Models with Wall Functions", International Journal for Numerical Methods in Fluids, vol. 18, 1994, pp. 695-719.

* cited by examiner

*Primary Examiner* — Juanita D Jackson
(74) *Attorney, Agent, or Firm* — Hollingsworth Davis, LLC

(57) ABSTRACT

The techniques described are applied for trapping particles within a partially enclosed region of a reservoir of a printer head using thermal gradients and buoyant flows within the ink contained in the reservoir. One disclosed embodiment includes a reservoir for an ink jet printer that has a plurality of walls and a cavity. The plurality of walls include at least a first wall and a second wall. During operation, the first wall is provided with a temperature differential with respect to the second wall. The cavity is formed by the plurality of walls and operationally retains an ink of the ink jet printer. The cavity has a partially enclosed region that communicates with a remainder of the cavity. The partially enclosed region is adapted to retain particles that have separated from the ink.

24 Claims, 10 Drawing Sheets

RESERVOIR HAVING PARTICLE TRAPPING FEATURES

TECHNICAL FIELD

This application relates generally to techniques useful for inkjet printing. The application also relates to components, devices, systems, and methods pertaining to such techniques.

BACKGROUND

Ink jet printers operate by using ink ejectors that eject small droplets of liquid ink onto print media according to a predetermined pattern. In some implementations, the ink is ejected directly on a final print media, such as paper. In some implementations, the ink is ejected on an intermediate print media, e.g. a print drum, and is then transferred from the intermediate print media to the final print media. Some ink jet printers use cartridges of liquid ink to supply the ink jets. The solid ink is melted in a page-width print head, which jets the molten ink in a page-width pattern onto an intermediate drum. The pattern on the intermediate drum is transferred onto paper through a pressure nip.

Ink that flows through the print head may contain debris in the form of particles of various sizes and compositions. This debris may clog an inlet, an outlet, an aperture or other manifolds and channels within the print head. This can result in weak, missing or intermittent jetting that can cause undesirable printing defects. To address this issue, filters have been included in the print head. Though effective at removing debris, the small pore size of these filters requires large pressure drops to force the ink through the filters and ensure the required throughput. For gravity driven loaders, the pressure drop across the filter is fixed by the height of the film wetting the filter. Because the driving force of gravity driven loaders is hydrostatic pressure, throughput of the ink jet printer can be limited due to the pressure drop caused by the filters.

SUMMARY

Embodiments discussed in the disclosure are directed to methods and devices used in ink jet printing. Some embodiments involve a reservoir for an ink jet printer that includes a plurality of walls and a cavity. The plurality of walls include at least a first wall and a second wall. During operation, the first wall is provided with a temperature differential with respect to the second wall. The cavity is formed by the plurality of walls and operationally retains an ink of the ink jet printer. The cavity has a partially enclosed region that communicates with a remainder of the cavity. The partially enclosed region is adapted to retain particles that have separated or settled from the ink.

Some embodiments involve a method for filtering particles from ink including the steps of providing a reservoir with a cavity containing the ink, the cavity includes a partially enclosed region, creating a thermal gradient within the ink so that the particles are entrained in a convective flow resulting from the thermal gradient, and trapping the particles within the partially enclosed region using the convective flow.

In some implementations, a system for filtering particles from ink includes a heat source and a reservoir. The reservoir contains the ink and has at least one wall thermally heated by the heat source to create a thermal gradient within the ink so that the particles in the ink are entrained in a convective flow generated by thermal gradient and brought into a partially enclosed region of the cavity.

The above summary is not intended to describe each embodiment or every implementation. A more complete understanding will become apparent and appreciated by referring to the following detailed description and claims in conjunction with the accompanying drawings.

DETAILED DESCRIPTION OF THE DRAWINGS

Figure 4:
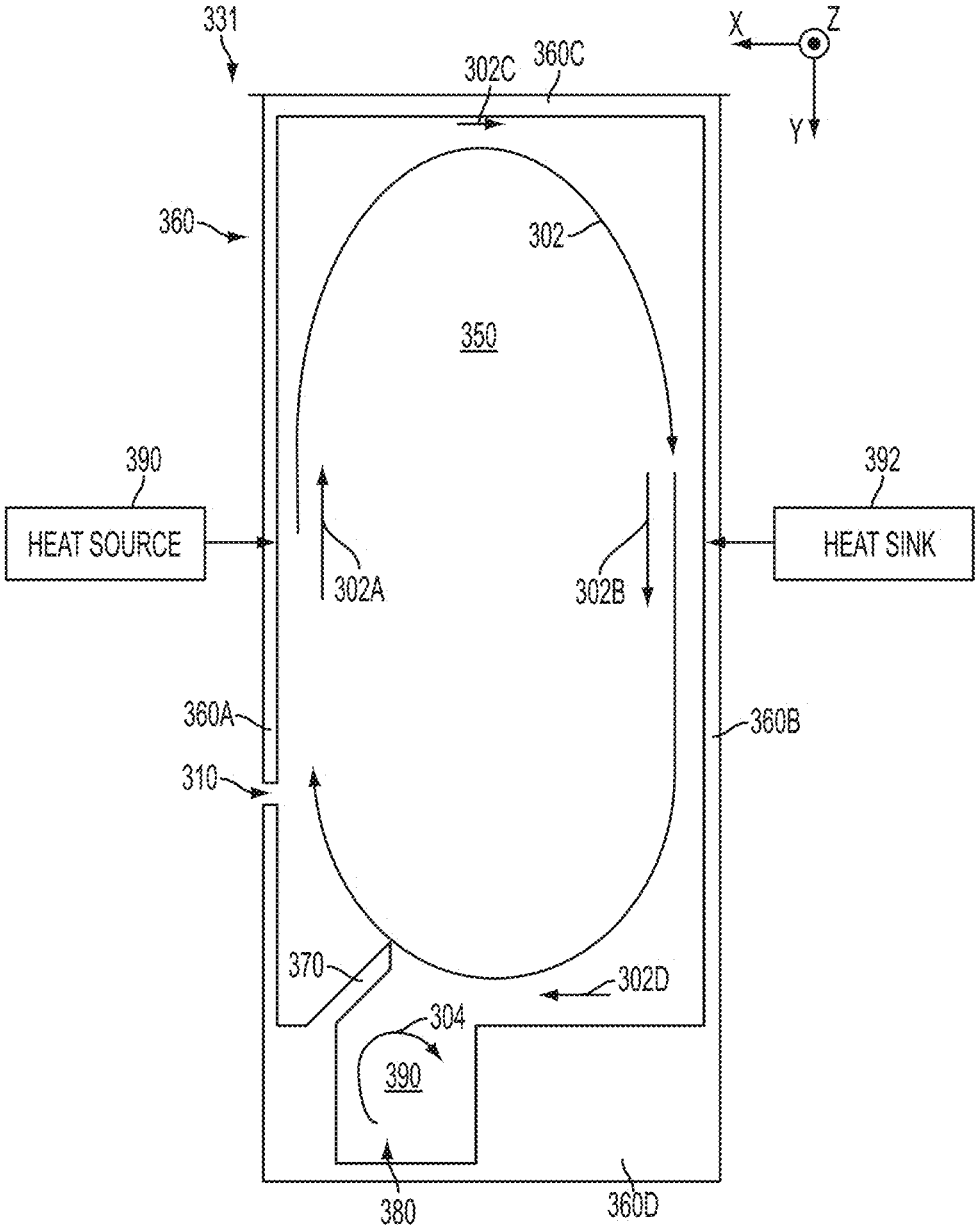
FIG. 4 is a schematic cross sectional view of an embodiment of the reservoir.
Figures 5A, 5B, 5C:
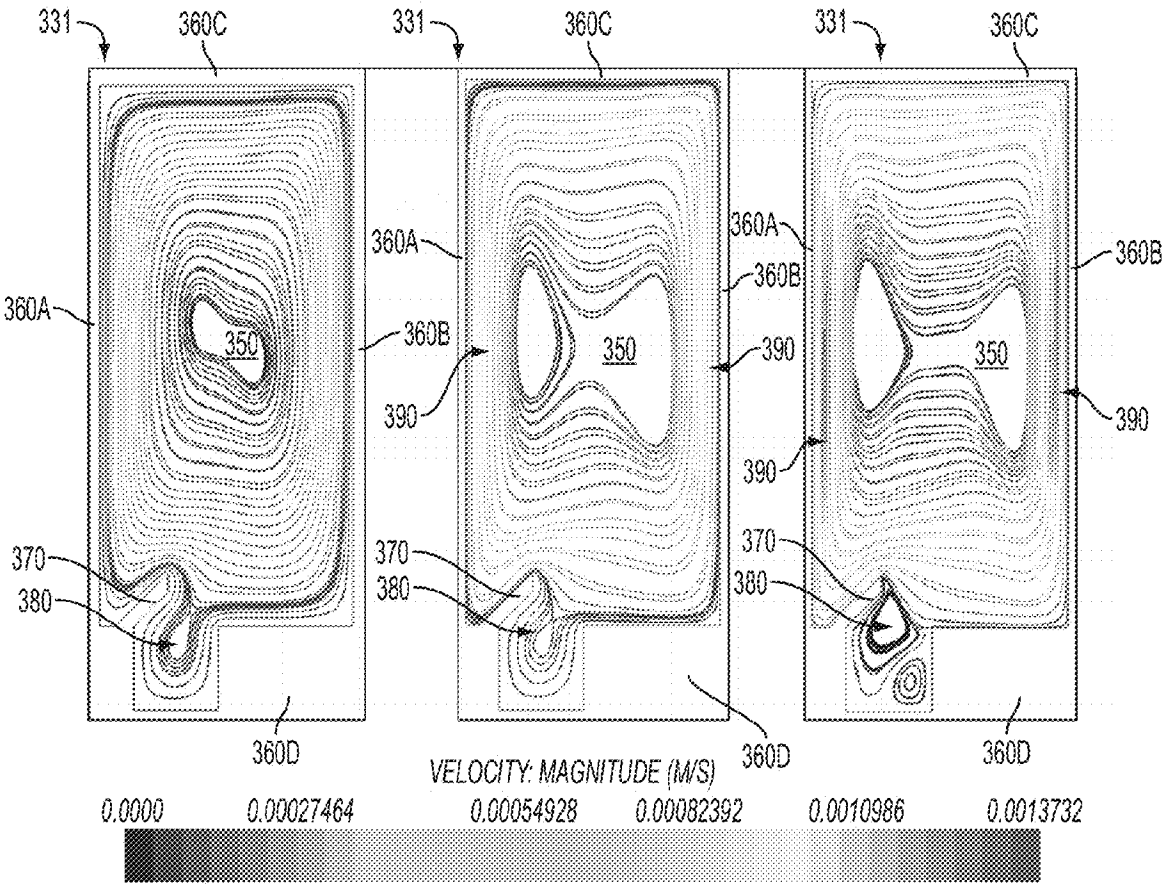
Figure 6:
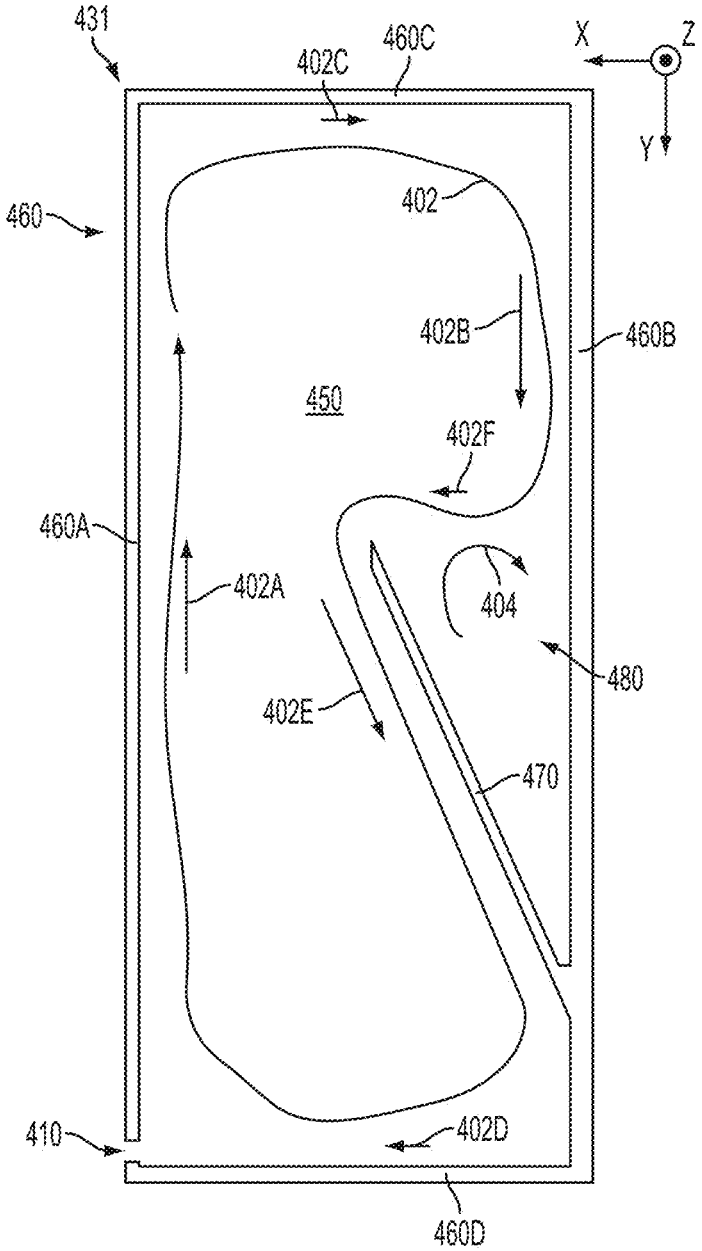
Figures 7A, 7B, 7C:
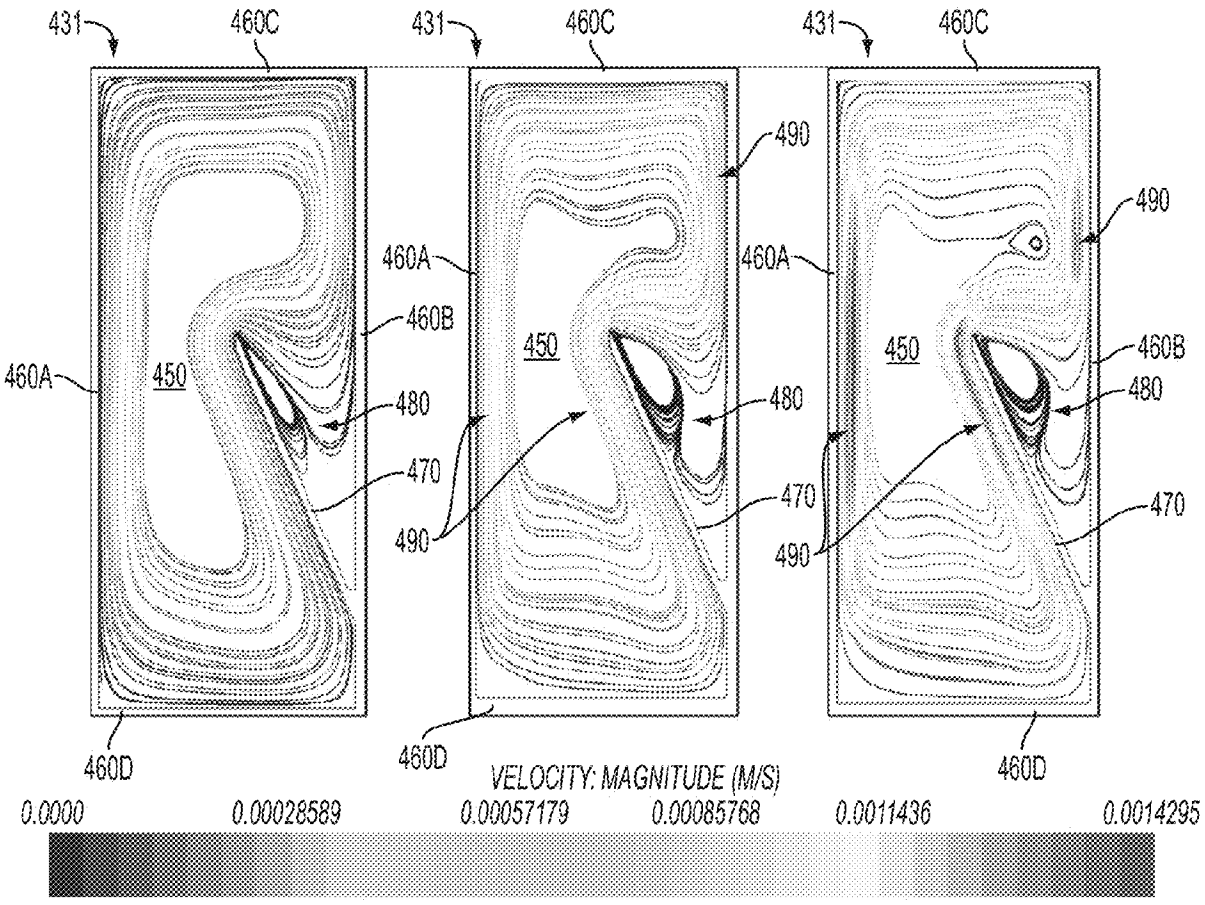
Figure 8:
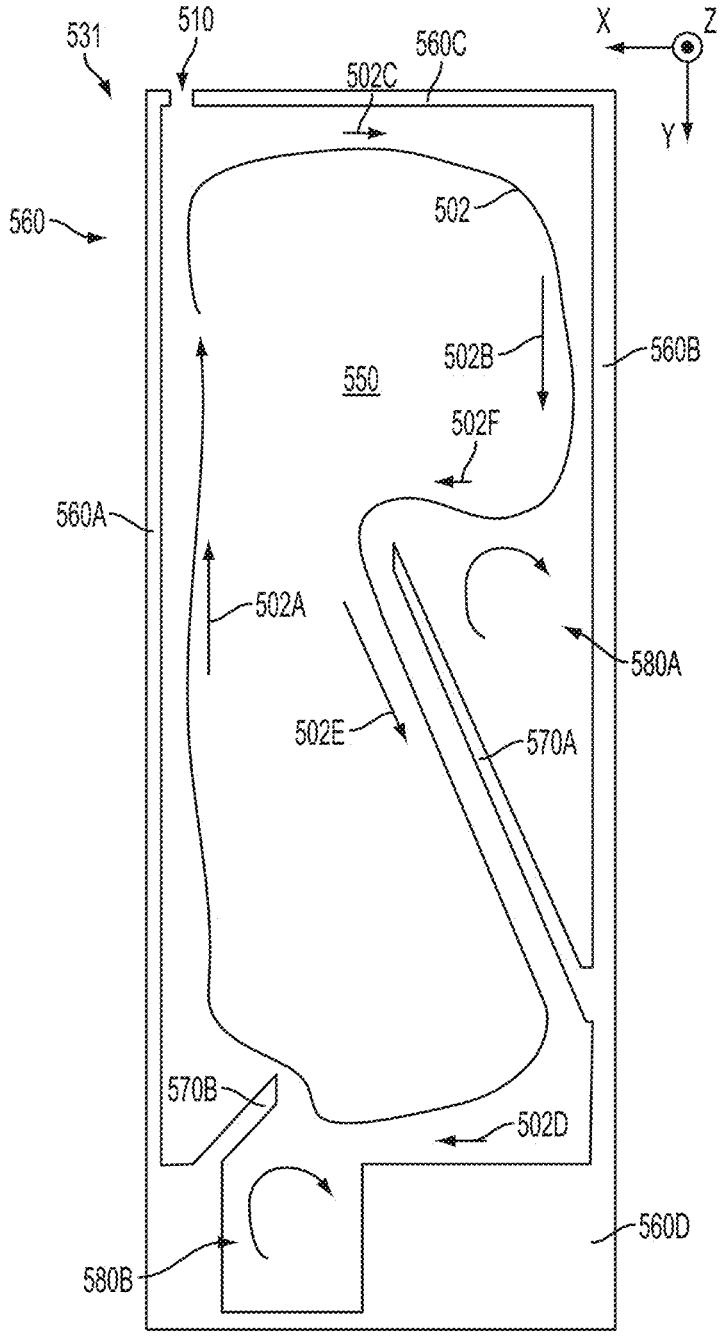
Figure 9:
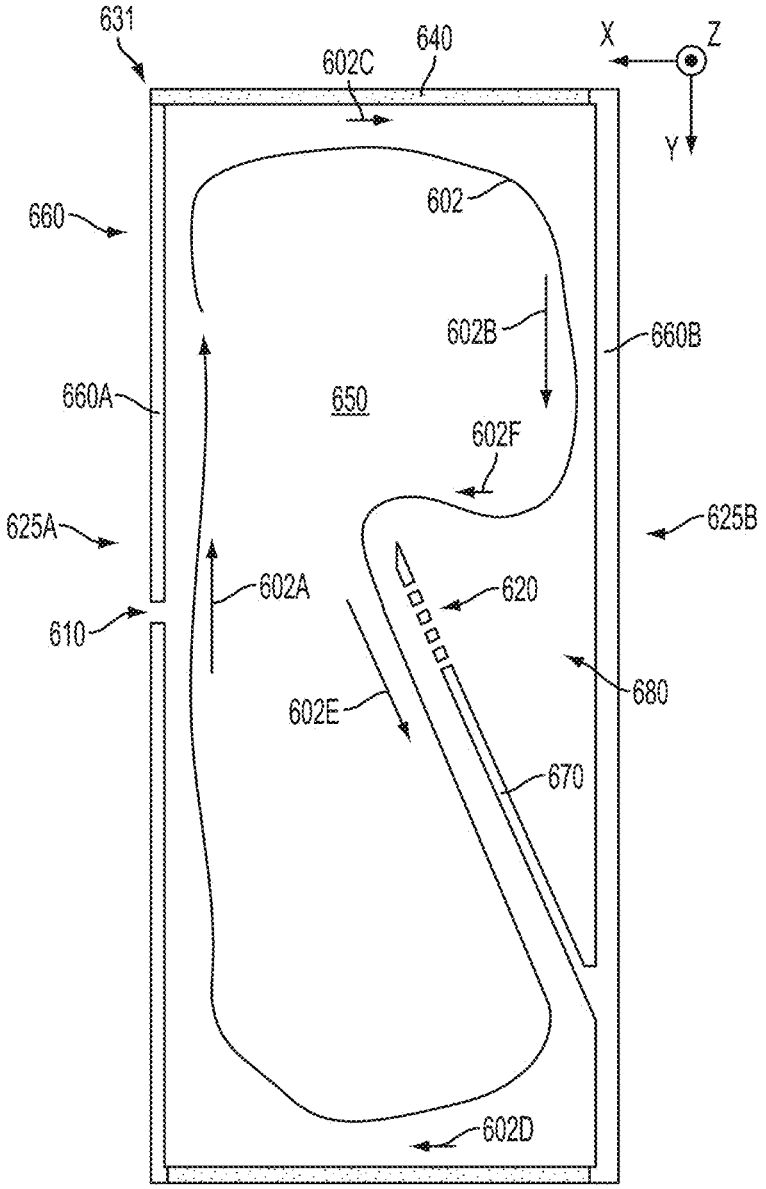
Figure 10:
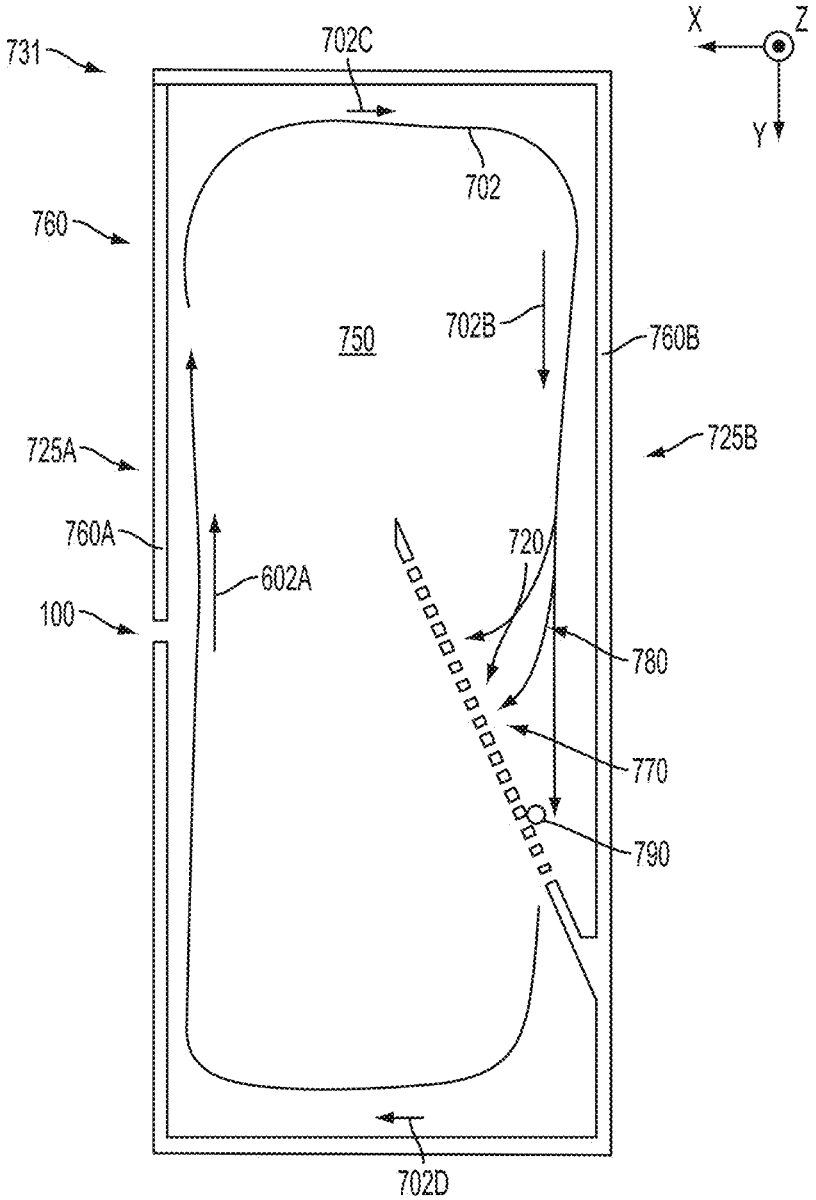
Figure 11:
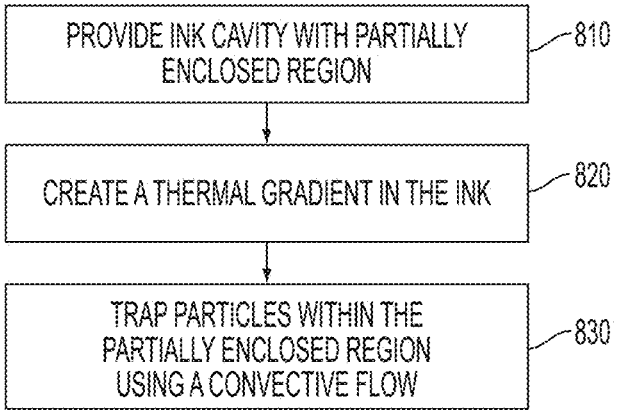

FIGS. 5A, 5B, and 5C illustrate the reservoir of FIG. 4 modeled at various temperature differentials and the flow fields that result from each temperature differential;

FIG. 6 is a schematic cross-sectional view of another embodiment of the reservoir;

FIGS. 7A, 7B, and 7C illustrate the reservoir of FIG. 6 modeled at various temperature differentials and the flow fields that result from each temperature differential;

FIG. 8 is a schematic cross-sectional view of yet another embodiment of the reservoir;

FIG. 9 is a schematic cross-sectional view another embodiment of the reservoir;

FIG. 10 shows a schematic cross-sectional view of yet another embodiment of a reservoir in accordance with some embodiments; and FIG. 11 illustrates a method for filtering particles from ink according to an exemplary embodiment.

The figures are not necessarily to scale. Like numbers used in the figures refer to like components. However, it will be understood that the use of a number to refer to a component in a given figure is not intended to limit the component in another figure labeled with the same number.

DESCRIPTION OF VARIOUS EMBODIMENTS

The present disclosure describes methods, systems, apparatuses, and techniques for segregating debris, hereinafter referred to as particles, from ink prior to the ink being jetted onto an intermediate or final print media. More particularly, the disclosure is directed to methods, systems, apparatuses, and techniques for trapping particles within a partially enclosed region of a reservoir of a printer head using thermal gradients and buoyant flows within the ink contained in the reservoir. The disclosed techniques are effective for trapping particles and do not limit the ink throughput in gravity driven loader configurations. Additionally, the techniques can reduce fabrication costs and time associated with providing the print head with filters.

Figure 1:
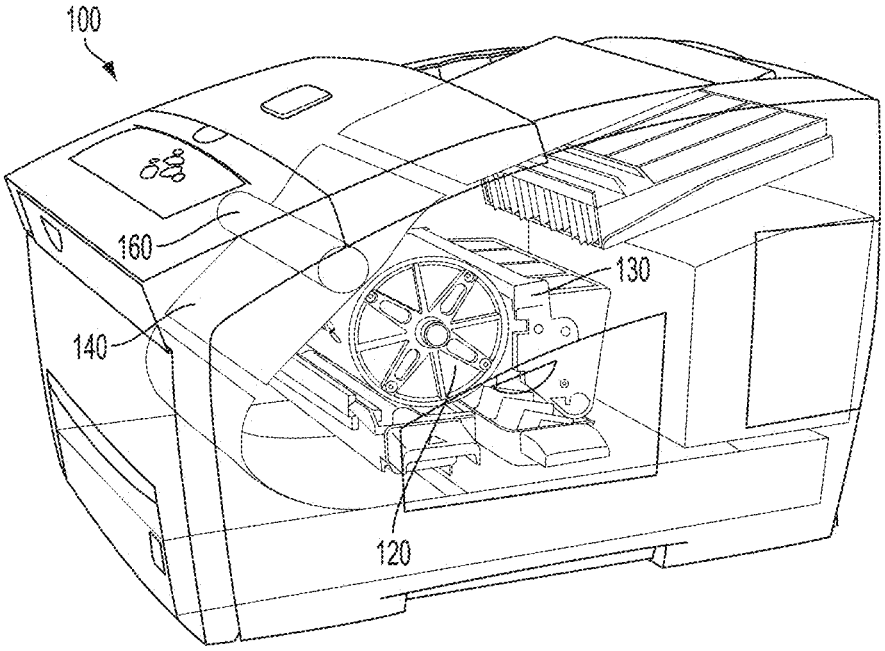
FIGS. 1 and 2 are internal views of portions of an ink jet printer that include a reservoir according to various embodiments.
Figure 2:
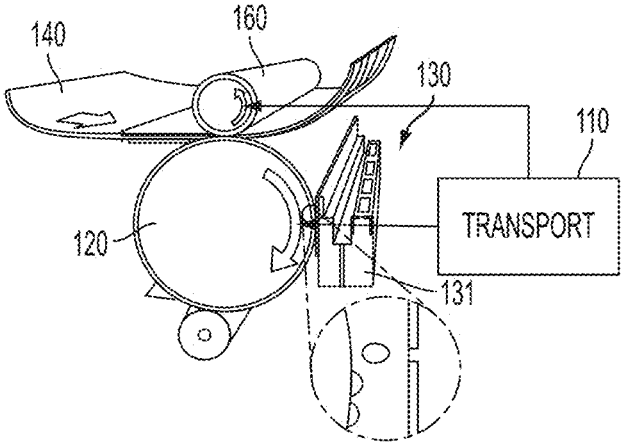

FIGS. 1 and 2 provide internal views of portions of an ink jet printer 100 that incorporate particle trapping techniques as discussed herein. The ink jet printer 100 includes a transport mechanism 110 that is configured to move a drum 120 relative to a print head 130 and to move a paper 140 relative to the drum 120. The print head 130 may extend fully or partially along the length of the drum 120 and may include, for example, one or more ink reservoirs 131 (FIG. 2), e.g., a reservoir for each color, and a print head manifold that communicates with a number of ink jets. As the drum 120 is rotated by the transport mechanism 110, the ink jets of the print head 130 deposit droplets of ink though ink jet apertures onto the drum 120 in the desired pattern. As the paper 140 travels around the drum 120, the pattern of ink on the drum 120 is transferred to the paper 140 through a pressure nip 160.

Figure 3:
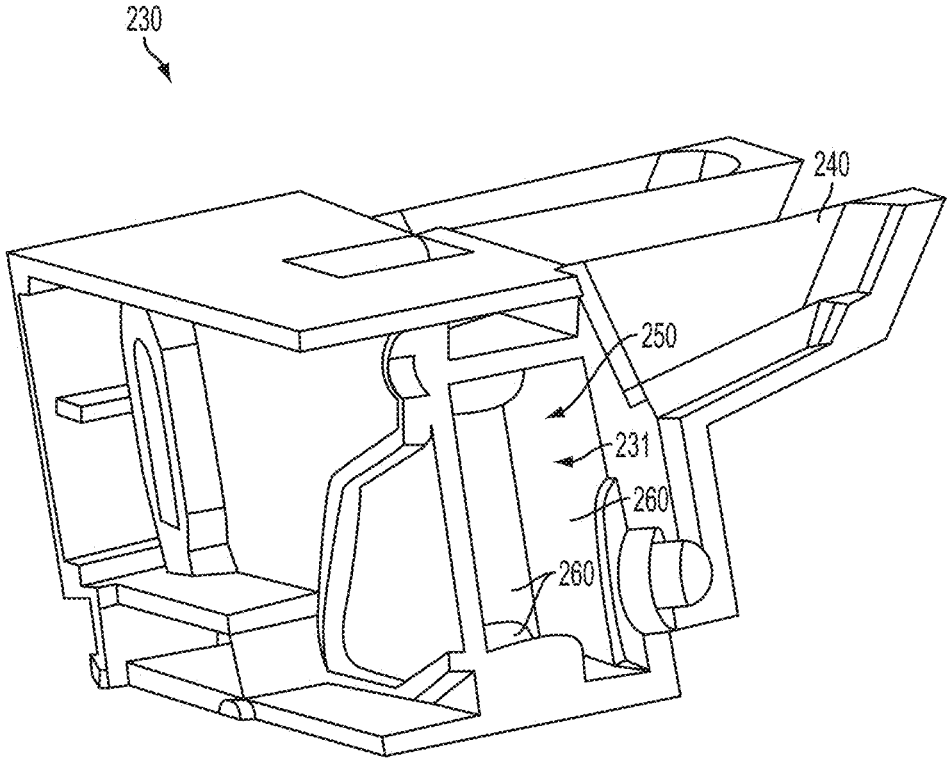
FIG. 3 is a cross sectional view of a portion of the print head of FIGS. 1 and 2 illustrating one embodiment of the reservoir.

FIG. 3 is a cross sectional view of an exemplary portion of a print head 230 that illustrates a reservoir 231 as further discussed schematically herein. The reservoir 231 is configured to contain a phase-change ink and is in fluid communication with other components of the print head 230 including a jet stack region (not shown) and rear feed manifolds 240. The jet stack region may include manifolds and ink jets. As used herein the term "reservoir" includes a cavity 250 as well as the plurality of walls 260, which immediately surround and define the cavity 250.

FIG. 4 illustrates a schematic cross sectional view of an embodiment of a reservoir 331 according to an exemplary embodiment. FIG. 4 illustrates a recirculating flow in the ink contained within a cavity 350 of the reservoir 331 with arrow 302. Arrows 302A, 302B, 302C, 302D are sized differently to indicate that the recirculating flow can have a different velocity in different areas of the cavity 350. One or more outlets 310 from the cavity 350 can be provided. The one or more outlets 310 fluidly communicate with the remainder of a print head. The one or more outlets 310 can be disposed in a location that minimizes a likelihood of a particle traveling through the one or more outlets 310. While FIG. 4 illustrates the nature of the recirculating flow at a high level, a more precise illustration of the recirculating flow can be obtained in reference to the flow fields of FIG. 5.

As discussed with reference to the previous embodiment, the reservoir 331 includes a cavity 350 and a plurality of walls 360. In the embodiment of FIG. 4, the plurality of walls 360 comprise a first wall 360A; a second wall 360B, a third wall 360C, and a fourth wall 360D, which are interconnected together. A projection 370 extends from the fourth wall 360D into the flow path and acts as an obstacle to the flow of particles. The cavity 350 includes a partially enclosed region 380 that communicates with a remainder of the cavity 350. Although illustrated in FIG. 4 as taking up roughly 5 to 10% of the total area of the cavity 350, partially enclosed region 380 can have an area of between 0.1% and 99.9% of the overall area of the cavity 350 in some embodiments. The partially enclosed region 380 is at least partially bounded by the projection 370, which extends from one of the plurality of walls 360 (the fourth wall 360D) into the flow path of the ink. In the embodiment of FIG. 4, the projection 370 is angled relative to both the first wall 360A and the second wall 360B. As will be discussed subsequently, the partially enclosed region 380 operates using viscous and buoyant forces within the ink and is adapted (in combination with the projection 370) to retain particles that have separated from the ink.

In FIG. 4, the partially enclosed region 380 is illustrated as a sump 390 at least partially formed by one or more of the plurality of walls (e.g. the fourth wall 360D) as well as the projection 370. The sump 390 is a lowered region of cavity 350 adapted to receive particles that settle from the flow.

The first wall 360A is disposed on an opposing side of the reservoir 331 from the second wall 360B and the two are spaced apart by the cavity 350. In order to induce a recirculating flow in the ink within the cavity 350, the first wall 360A can be provided with a temperature differential with respect to the second wall 360B. Thus, the plurality of walls 360 should not be overly conductive so as to make the reservoir 331 isothermal. As will be discussed, the plurality of walls 360 can be tuned to allow for conditions that facilitate a temperature gradient in the ink that varies along the x direction of the Cartesian coordinate system illustrated. Tuning of the plurality of walls 360 can include one or more of selecting a material for each of the plurality of walls 360 to have a desired thermal conductivity, giving the plurality of walls 360 a desired shape, and providing heating and/or cooling to the first wall 360A and/or the second wall 360B.

In some cases, the reservoir 331 may take advantage of temperature differentials the print head is subjected to. For example, at least one heat source 392 can be used within the print head to warm adjacent regions (e.g., the jet stack region). Heat from the at least one heat source 392 can be provided to warm the first wall 360A relative to the second wall 360B in some instances. Similarly, at least one heat sink 394 can occur adjacent to or within the print head (e.g., air surrounds portions of the print head). The at least one heat sink 394 can be used to cool the second wall 360B relative to the first wall 360A. Heating and cooling using the heat source 392 and the heat sink 394 can occur either alone or in tandem as desired. Thus, the heat source 392 can be disposed in thermal contact with the first wall 360A to warm the first wall 360A relative to the second wall 360B to create the temperature differential therebetween, in some embodiments.

In other embodiments, the plurality of walls 360 can be constructed to achieve a desired temperature differential between the first wall 360A and the second wall 360B. For example, the first wall 360A can be comprised of a first material having a first thermal conductivity, and the second wall 360B can be comprised of a second material having a different thermal conductivity than the first thermal conductivity of the first wall 360A. The different thermal conductivities of the first wall 360A and the second wall 360B allow for the temperature differential and the thermal gradient in the ink.

In other embodiments, one or more of the plurality of walls 360 that extend between the first wall 360A and the second wall 360B (i.e., the walls 360C and 360D and/or the front and rear walls that are not shown in the cross-section) can be comprised of a thermally insulating material. This allows no strong temperature gradient to develop along the surface of the walls 360C and 360D and allows the first wall 360A to have a temperature differential with respect to the second wall 360B. Thus, the temperature differential between the first wall 360A and the second wall 360B creates the dominant temperature gradient across the ink (along the x direction of the Cartesian coordinate system) and leads to the recirculating flow.

In yet other instances, one or more of the third wall 360C, and the fourth wall 360D can be comprised of an adiabatic material or a highly insulating material. As used herein, a highly insulating material comprises a material that is at least twice as insulating as the least insulating material used for one or both of the first wall 360A and the second wall 360B. Thus, for the third wall 360C or the fourth wall 360D, $k>2X$, where X=highest k of the first wall 360A and the second wall 360B. Again, this configuration allows for the temperature differential between the first wall 360A and the second wall 360B.

In yet other embodiments, the second wall 360B can be comprised of a thermally conductive material allowing the heat sink 394 to be used to more effectively cool the second wall 360B relative to the first wall 360A.

The reservoir 331 can be modeled as a fluid filled enclosure. Thus, heating from one side will lead to a flow in the enclosure according to Equation (1) when Ra is greater than 1000 as with ink:

$$Ra=\rho g\beta\Delta TL^3/\mu\alpha \quad 1)$$

where, k is the thermal conductivity of the fluid, ρ is the density, β is the coefficient of thermal expansion, a is the thermal diffusivity, μ is the fluid viscosity, L is the a typical vertical distance of the wall, g is the gravitational acceleration, and ΔT is the temperature difference across the enclosure.

As Ra is increased, the flow in the ink transitions through a number of regimes, beginning with laminar recirculation with a single core vortex at lower Ra and ultimately transitioning to turbulent flow at higher Ra. At a small Ra, the size of the fluid boundary layer around the perimeter is largest. As Ra is increased, the fluid velocity increases, but the size of the boundary layer decreases. Larger boundary layers can be useful because a larger region of ink within the cavity 350 is subject to flow. Additionally, larger boundary layers are useful where particles are less dense such that the larger boundary layer would set a larger portion of the less dense particles in motion to eventually be trapped. Similarly, small boundary layers can be useful for situations where a high velocity flow is desired. Such situations can occur where particles have a higher density. A higher velocity flow would be better able to entrain the higher density particles. The size of the boundary layer scales weakly with Ra (boundary layer ~Ra^0.25) so the boundary layer can be determined once an appropriate Ra is selected.

Utilizing Equation (2) it can be determined that any particle (debris) in the reservoir 331 will be subjected to two dominant forces. The first comprises a viscous force imparted from the thermally driven flow in the ink. The second comprises a buoyant force from the action of gravity. Since the particles can be relatively small, the fluid force is dominated by the viscous component and depends linearly on the velocity. As long as this force is greater than the force from gravity one would expect that the particles travel along with the recirculating flows. Balancing the fluid force with the buoyant forces one can determine that any particle(s) with a characteristic length smaller than:

$$d=[9U\mu/2(\rho_p-\rho_f)g]^{0.5} \quad (2)$$

where U is the local fluid velocity, $\rho_p$ the density of the particle, g is the gravitational acceleration, and $\rho_f$ is the density of the fluid, will be convected by the flow. An estimate of the particle size and density that can be entrained can be approximated by using Equation (2) with the following approximation for the fluid velocity:

$$U\sim[\beta\Delta TgL]^{0.5} \quad (3)$$

where β is the coefficient of thermal expansion, L is the a typical vertical distance of the wall, g is the gravitational acceleration, and ΔT is the temperature difference across the enclosure.

As an example, for aluminum particles in ink subjected to a flow of 0.5 mm/s the maximum particle size that can be convected is ~35 μm. For lower density particles, the maximum particle size will be larger according to Equation (2). As the entrained particles travel along the perimeter of the cavity 350 adjacent the plurality of walls 360, each particle experience(s) a variety of flow magnitudes as illustrated by arrows 302A, 302B, 302C, and 302D. The velocity of flow in the partially enclosed region 380 (i.e., the sump 390) approaches zero. However, in some instances a flow 304 having a low velocity in a direction counter to the main cavity flow can develop. In either case, the particles that are driven near the partially enclosed region 380 will be subject to a flow 304 that has little vertical (lifting) component relative to the gravity force. Thus, the particles will settle into the partially enclosed region 380 and be trapped from the remainder of the ink.

Any particle not satisfying the criterion of Equation (2) is still be subjected to viscous forces, but will not be driven against gravity. Instead, each particle will travel down the cavity and eventually settle along the bottom (i.e. the fourth wall 360D). However, the flow travels adjacent the plurality of walls 360 such that settled particles are still subject to the viscous driving force. This force shuffles the particles along the bottom wall until they reach the partially enclosed region 380 and are trapped from the remainder of the ink.

EXAMPLES

FIGS. 5A, 5B, and 5C show the reservoir 331 modeled at various temperature differentials and the flow fields that result from each temperature differential. As discussed, a thermal gradient across the reservoir 331 leads to recirculating flows (illustrated with flow fields) such as those illustrated in FIGS. 5A, 5B, and 5C. FIG. 5A shows the resulting flow field with a temperature differential of 1° C. between the relatively warmer first wall 360A and the relatively cooler second wall 360B. FIG. 5B shows the resulting flow field with a temperature differential of 5° C. between the relatively warmer first wall 360A and the relatively cooler second wall 360B. FIG. 5C shows the resulting flow field with a temperature differential of 10° C. between the relatively warmer first wall 360A and the relatively cooler second wall 360B.

For the simulation, the cavity 350 is assumed to have dimensions appropriate for a print head reservoir (e.g. a width in the x direction of 1.5 cm and a height in the y direction of 1.5 cm). Ra was assumed to be between 10^5 to 10^6. Commercial CFD software (Starccm+, CD-Adapco) was used to simulate the flow field that would be generated in the reservoir 331 filed with ink. The simulation assumes the first wall 360A is isothermal and is set to a fixed temperature. The second wall 360B is varied to allow for the temperature difference. The third wall 360C, the fourth wall 360D, and the projection 370 were assumed to be adiabatic.

As shown by the flow fields in the FIGS. 5A-5C, the ink within the cavity has a relatively stronger velocity of flow adjacent the first and second walls 360A and 360B while the flow adjacent the third and fourth walls 360C and 360D is relatively weaker. As discussed in reference to FIG. 4, the flow recirculates in a clockwise direction when the first wall 360A is relatively warmer than the second wall 360B. The flow simulations performed demonstrate that in the configuration of FIGS. 5A-5C can attain a recirculating flow with velocities ranging from 0.5-1.4 mm/s. As the temperature difference across the reservoir 331 is increased the velocities of the flow increase while the boundary layer decreases. As shown, the streamlines are concentrated along the perimeter of the cavity. Thus, particles of an appropriate size and density are entrained and carried by the flow adjacent the perimeter of the cavity 350 before being obstructed and trapped by the projection 370 and the partially enclosed region 380. As shown in FIGS. 5B and 5C, areas 390 of increased recirculating flow velocities have developed adjacent walls 360A and 360B. These areas 390 have velocities of between about 1.0 mm/s and 1.4 mm/s.

FIG. 6 shows a schematic cross-sectional view of another embodiment of a reservoir 431 including a cavity 450 and a plurality of walls 460. FIG. 6 illustrates a recirculating flow in the ink contained within the cavity 450 of the reservoir 431 with arrow 402. Arrows 402A, 402B, 402C, 402D, 402E, and 402F are sized differently to indicate that the recirculating flow can have a different velocity in different areas of the cavity 450. Similar to the embodiment of FIG. 4, the embodiment of FIG. 6 is provided with a temperature differential between the relatively warmer first wall 460A and the relatively cooler second wall 460B. The temperature differential can be generated using the various methods discussed in reference to FIG. 4. One or more outlets 410 from the cavity 450 can be provided and can be disposed in a location that minimizes a likelihood of a particle traveling through the one or more outlets 410.

A projection 470 extends from the second wall 460B into the flow path. The cavity 450 includes a partially enclosed region 480 that communicates with a remainder of the cavity 450. The partially enclosed region 480 is at least partially bounded by the projection 470, which extends from one of the plurality of walls 460 (the second wall 460B) into the flow path of the ink. In the embodiment of FIG. 6, the projection 470 is angled relative to both the first wall 460A and the second wall 460B. The partially enclosed region 480 is adapted to capture and retain particles from the ink that are more dense than the ink, as well as particles that are slightly less dense than the ink and do not immediately drop to the bottom of the cavity 450. Instead of dropping to the bottom wall, these less dense particles are entrained and travel along the perimeter of the cavity 450 adjacent the plurality of walls 460 according to Equation (2). The velocity of flow in the partially enclosed region 480 approaches zero. However, in some instances a low velocity flow 404 counter to the main cavity flow can develop. In either case, the particles that are driven near the partially enclosed region 480 will be subject to the main cavity flow that has little vertical (lifting) component relative to the gravity force. Thus, the particles will settle into the partially enclosed region 480 and be trapped from the remainder of the ink.

Examples

FIGS. 7A, 7B, and 7C show the reservoir 431 modeled at various temperature differentials and the flow fields that result from each temperature differential. As discussed, a thermal gradient across the reservoir 431 leads to recirculating flows (illustrated with flow fields) such as those illustrated in FIGS. 7A, 7B, and 7C. FIG. 7A shows the resulting flow field with a temperature differential of 1° C. between the relatively warmer first wall 460A and the relatively cooler second wall 460B. FIG. 7B shows the resulting flow field with a temperature differential of 5° C. between the relatively warmer first wall 460A and the relatively cooler second wall 460B. FIG. 7C shows the resulting flow field with a temperature differential of 10° C. between the relatively warmer first wall 460A and the relatively cooler second wall 460B.

The reservoir 431 was modeled under conditions identical to the conditions for the embodiment of FIGS. 5A, 5B, and 5C. As shown by the flow fields in the FIGS. 7A-7C, the ink within the cavity has a relatively stronger velocity of flow adjacent the first and second walls 460A and 460B and adjacent the projection 470 while the flow adjacent the third and fourth walls 460C and 460D is relatively weaker. The flow recirculates in a clockwise direction when the first wall 460A is relatively warmer than the second wall 460B. The flow simulations performed demonstrate that in the configuration of FIGS. 7A-7C a recirculating flow can be obtained with velocities ranging from 0.5-1.4 mm/s. As the temperature difference across the reservoir 431 is increased the velocities of the flow increase while the boundary layer decreases. The streamlines are concentrated adjacent the perimeter of the cavity. As discussed previously, particles of an appropriate size and density are entrained and carried by the flow along the perimeter of the cavity 450 before being obstructed and trapped by the projection 470 and the partially enclosed region 480. Areas 490 with increased velocity of recirculating flow develop in FIGS. 5B and 5C adjacent walls 460A, 460B, and projection 470. These areas 490 have a flow velocity of between about 1.0 mm/s and 1.4 mm/s.

FIG. 8 shows a schematic cross-sectional view of another embodiment of a reservoir 531 including a cavity 550 and a plurality of walls 560. FIG. 8 illustrates a recirculating flow in the ink contained within the cavity 550 of the reservoir 531 with arrow 502. Arrows 502A, 502B, 502C, 502D, 502E, and 502F are sized differently to indicate that the recirculating flow can have a different velocity in different areas of the cavity 550. Similar to the embodiment of FIG. 4, the embodiment of FIG. 8 is provided with a temperature differential between the relatively warmer first wall 560A and the relatively cooler second wall 560B. The temperature differential can be generated using the various methods discussed in reference to FIG. 4. One or more outlets 510 from the cavity 550 can be provided and can be disposed in a location that minimizes a likelihood of a particle traveling through the one or more outlets 510.

A first projection 570A extends from the second wall 560B into the flow path and a second projection 570B extends from the fourth wall 560D into the flow path. Thus, a plurality of projections are spaced along one or more of the plurality of walls 560 in the embodiment of FIG. 8. The cavity 550 includes a first partially enclosed region 580A and a second partially enclosed region 580B. Each of the first and second partially enclosed regions 580A and 580B communicates with a remainder of the cavity 550. The first partially enclosed region 580A is at least partially bounded by the first projection 570A. The second partially enclosed region 580B is at least partially bounded by the second projection 570B. Thus, reservoir 531 is comprised of a plurality of partially enclosed regions spaced along at least a side wall and a bottom wall of the reservoir 531. In the embodiment of FIG. 8, the first projection 570A and the second projection 570B are both angled in a non-orthogonal manner relative to the first wall 560A and the second wall 560B.

FIG. 9 shows a schematic cross-sectional view of yet another embodiment of a reservoir 631 including a cavity 650 and a plurality of walls 660. FIG. 9 illustrates a recirculating flow in the ink contained within the cavity 650 of the reservoir 631 with arrow 602. Arrows 602A, 602B, 602C, 602D, 602E, and 602F are sized differently to indicate that the recirculating flow can have a different velocity in different areas of the cavity 650. Similar to the embodiment of FIG. 4, the embodiment of FIG. 9 is provided with a temperature differential between the relatively warmer first wall 660A and the relatively cooler second wall 660B. The temperature differential can be generated using the various methods discussed in reference to FIG. 4. One or more outlets 610 from the cavity 650 can be provided and can be disposed in a location that minimizes a likelihood of a particle traveling through the one or more outlets 610.

A projection 670 extends from the second wall 660B into the flow path. The projection 670 includes a plurality of holes 620 extending therethrough. The plurality of holes 620 can be sized to be smaller than an average expected diameter of the particles. Thus, the projection 670 can act as a sieve by allowing some flow of ink through the plurality of holes 620 while capturing the particles. The cavity 650 includes a partially enclosed region 680 that communicates with a remainder of the cavity 650. In the embodiment of FIG. 9, the reservoir 631 is comprised of two portions 625A and 625B. The two portions 625A and 625B are separated by an insulated bonding material 640. In some instances, the first portion 625A can be comprised of a first material having a first thermal conductivity and the second portion 625B is comprised of a second material having a second thermal conductivity that is different than the first thermal conductivity. In the embodiment of FIG. 9, the insulated bonding material 640 is disposed between the first wall 660A and the second wall 660B and allows for the temperature differential between the first wall 660A and the second wall 660B.

FIG. 10 shows a schematic cross-sectional view of yet another embodiment of a reservoir 731 including a cavity 750 and a plurality of walls 760. FIG. 10 illustrates a recirculating flow in the ink contained within the cavity 750 of the reservoir 731 with arrow 702. Arrows 702A, 702B, 702C, and 702D are sized differently to indicate that the recirculating flow can have a different velocity in different areas of the cavity 750. Similar to the embodiment of FIG. 4, the embodiment of FIG. 10 is provided with a temperature differential between the relatively warmer first wall 760A and the relatively cooler second wall 760B. The temperature differential can be generated using the various methods discussed in reference to FIG. 4. One or more outlets 710 from the cavity 750 can be provided and can be disposed in a location that minimizes a likelihood of a particle traveling through the one or more outlets 710.

The cavity 750 includes a partially enclosed region 780 that communicates with a remainder of the cavity 750. A projection 770 extends from the second wall 760B into the flow path. The projection 770 includes a plurality of holes 720 extending therethrough. The plurality of holes 720 can be sized to be smaller than an average expected diameter of the particles. Thus, the projection 770 can act as a sieve by allowing some flow of ink through the plurality of holes 720 while capturing the particles. FIG. 10 illustrates one such particle 790. This particle 790 can be buoyant (i.e. less dense than ink) yet is still captured in the partially enclosed region 780 abutting the projection 770. Indeed, the recirculating flow passing through the sieve pushes the particle 790 against the projection 770 in the sieve area and keeps the particle 790 trapped there as long as viscous force on the particle 790 is greater than buoyant force.

FIG. 11 illustrates a method for filtering particles from ink according to one embodiment. In step 810, the method provides a reservoir with a cavity containing the ink. The cavity includes a partially enclosed region. The method creates a thermal gradient within the ink so that the particles are entrained in a convective flow resulting from the thermal gradient at step 820. In step 830, the method traps the particles within the partially enclosed region using the convective flow. Additional method steps or sub-steps can be performed in some instances. The additional method steps include creating a temperature differential between a first wall and a second wall of the reservoir by bonding two or more sections each having a desired thermal conductivity together to form the reservoir. The method can also dispose an insulating bonding material between the two or more sections of the reservoir to optimize the thermal resistance between the two or more sections. Additionally, one or more outlets from the cavity to a remainder of a print head can be provided. The one or more outlets can be disposed in a location(s) that minimizes a likelihood of a particle traveling through the one or more outlets. In some instances, the partially enclosed region can include one or both of a projection extending from one of a plurality of walls of the reservoir and a sump at least partially formed by one or more of the plurality of walls.

Although embodiments herein are described in reference to reservoirs with four illustrated walls, in other embodiments reservoirs having additional or less walls are contemplated. As used herein, the word "printer" encompasses any apparatus that performs a print outputting function for any purpose, such as a digital copier, bookmaking machine, facsimile machine, a multi-function machine, etc. In the description below, reference is made in the text and the drawings to a printer head; however, the discussion is applicable to other micro-fluidic devices that dispense liquid or pump fluid. Therefore, the description should not be read to limit the application of this disclosure to printer heads alone.

Various modifications and additions can be made to the preferred embodiments discussed above. Systems, devices or methods disclosed herein may include one or more of the features, structures, methods, or combinations thereof described herein. For example, a device or method may be implemented to include one or more of the features and/or processes described below. It is intended that such device or method need not include all of the features and/or processes described herein, but may be implemented to include selected features and/or processes that provide useful structures and/or functionality.

What is claimed is:

1. A reservoir for an ink jet printer, comprising:

a plurality of walls including at least a first wall and a second wall, wherein the first wall is operationally provided with a temperature differential with respect to the second wall, the second wall comprising a thermally conductive material;

a heat sink in thermal contact with the second wall; and a cavity formed by the plurality of walls for retaining an ink of the ink jet printer, wherein the cavity has a partially enclosed region that communicates with a remainder of the cavity, and the partially enclosed region is adapted to retain particles that have separated from the ink.

2. The reservoir of claim 1, wherein the first wall is comprised of a first material having a first thermal conductivity and the second wall is comprised of a second material having a second thermal conductivity that is different than the first thermal conductivity.

3. The reservoir of claim 2, wherein the first wall is disposed on an opposing side of the reservoir from the second wall.

4. The reservoir of claim 1, wherein one or more of the plurality of walls that extends between the first wall and the second wall is comprised of a thermally insulating material.

5. The reservoir of claim 1, wherein one or more of the plurality of walls is comprised of an adiabatic material or a highly insulating material.

6. The reservoir of claim 1, further comprising a heat source in thermal contact with the first wall.

7. The reservoir of claim 1, wherein the partially enclosed region has an area of between 0.1% and 99.9% of the overall area of the reservoir cavity.

8. The reservoir of claim 1, further comprising one or more outlets from the cavity allowing the cavity to fluidly communicate with the remainder of a print head, wherein the one or more outlets are disposed in a location along the plurality of walls that minimizes a likelihood of a particle traveling through the one or more outlets.

9. A reservoir for an ink jet printer, comprising:

a plurality of walls including at least a first wall and a second wall, wherein the first wall is operationally provided with a temperature differential with respect to the second wall; and a cavity formed by the plurality of walls for retaining an ink of the ink jet printer, wherein the cavity has a partially enclosed region that communicates with a remainder of the cavity, the partially enclosed region adapted to retain particles that have separated from the ink, wherein the partially enclosed region is at least partially bounded by a projection extending from one of the plurality of walls into a flow path of the ink, the projection acting as an obstacle to flow of the particles, the projection comprising at least one of:

an angle relative to both the first wall and the second wall;

a plurality of projections spaced along one or more of the plurality of walls; and a plurality of holes extending through the projection.

10. The reservoir of claim 9, wherein the projection is angled relative to both the first wall and the second wall.

11. The reservoir of claim 9, wherein the projection comprises a plurality of projections spaced along one or more of the plurality of walls.

12. The reservoir of claim 9, wherein the projection includes a plurality of holes extending therethrough.

13. A reservoir for an ink jet printer, comprising:

a plurality of walls including at least a first wall and a second wall, wherein the first wall is operationally provided with a temperature differential with respect to the second wall; and a cavity formed by the plurality of walls for retaining an ink of the ink jet printer, wherein the cavity has a partially enclosed region that communicates with a remainder of the cavity, the partially enclosed region adapted to retain particles that have separated from the ink, the partially enclosed region comprising a sump that is at least partially formed by one or more of the plurality of walls.

14. A reservoir for an ink jet printer, comprising:

a plurality of walls including at least a first wall and a second wall, wherein the first wall is operationally provided with a temperature differential with respect to the second wall; and a cavity formed by the plurality of walls for retaining an ink of the ink jet printer, wherein the cavity has a partially enclosed region that communicates with a remainder of the cavity, the partially enclosed region adapted to retain particles that have separated from the ink, the partially enclosed region comprising a plurality of partially enclosed regions spaced along at least a side wall and a bottom wall of the reservoir.

15. A reservoir for an ink jet printer, comprising:

a plurality of walls including at least a first wall and a second wall, wherein the first wall is operationally provided with a temperature differential with respect to the second wall;

a cavity formed by the plurality of walls for retaining an ink of the ink jet printer, wherein the cavity has a partially enclosed region that communicates with a remainder of the cavity, the partially enclosed region adapted to retain particles that have separated from the ink; and an insulated bonding material disposed between the first wall and the second wall.

16. A method for filtering particles from ink, comprising:

providing a reservoir with a cavity containing the ink, wherein the cavity includes a partially enclosed region, the reservoir comprising a first wall and a second wall, the second wall comprising a thermally conductive material;

sinking heat using a heat sink in thermal contact with the second wall;

creating a thermal gradient within the ink so that the particles are entrained in a convective flow resulting from the thermal gradient; and trapping the particles within the partially enclosed region using the convective flow.

17. The method of claim 16, wherein the step of creating the thermal gradient within the ink includes creating a temperature differential between a first wall and a second wall of the reservoir.

18. The method of claim 16, further comprising providing one or more outlets from the cavity to a remainder of a print head that are disposed in a location that minimizes a likelihood of the particles traveling through the one or more outlets.

19. The method of claim 16, wherein the partially enclosed region includes one or both of a projection extending from one of a plurality of walls of the reservoir and a sump at least partially formed by one or more of the plurality of walls.

20. A system for filtering particles from ink, comprising:

a heat source;

a reservoir containing the ink, the reservoir comprising a first wall and a second wall, the second wall comprising a thermally conductive material and, at least one of the first wall and the second wall thermally heated by the heat source to create a thermal gradient within the ink so that the particles are entrained in a convective flow and brought into a partially enclosed region of a cavity of the reservoir; and a heat sink in thermal contact with the second wall.

21. The system of claim 20, wherein the reservoir includes a first portion comprised of a first material having a first thermal conductivity and a second portion comprised of a second material having a second thermal conductivity that is different than the first thermal conductivity.

22. The system of claim 20, further comprising an insulated bonding material disposed between a first portion of the reservoir and a second portion of the reservoir.

23. The system of claim 20, wherein the partially enclosed region is at least partially bounded by a projection extending into a flow path of the ink.

24. The system of claim 20, wherein the partially enclosed region includes a sump at least partially formed by one or more of the plurality of walls.

* * * * *